US006508447B1

(12) United States Patent
Catani et al.

(10) Patent No.: US 6,508,447 B1
(45) Date of Patent: Jan. 21, 2003

(54) REINFORCEMENT BAR SUPPORT SYSTEM

(75) Inventors: Mario J. Catani, Long Grove, IL (US); David A. Niday, Springsboro, OH (US)

(73) Assignee: Dur-O-Wal, Inc., Miamisburg, OH (US)

( * ) Notice: Subject to any disclaimer, the term of this patent is extended or adjusted under 35 U.S.C. 154(b) by 326 days.

(21) Appl. No.: 09/016,495

(22) Filed: Jan. 30, 1998

(51) Int. Cl.[7] ..... A47F 5/00

(52) U.S. Cl. ..... 248/300; 248/65; 52/699

(58) Field of Search ..... 248/300, 65; 52/686, 52/699, 295, 702, 126.7; 249/219.1

(56) References Cited

U.S. PATENT DOCUMENTS 1,357,893 A * 11/1920 Northrop ..... 248/300
1,472,955 A * 11/1923 Behringer ..... 248/300
1,726,286 A * 8/1929 Bennet ..... 52/699
1,734,407 A * 11/1929 Taussig ..... 52/699
2,691,293 A * 10/1954 Patterson ..... 52/699
2,729,411 A * 1/1956 Cahill ..... 248/300
2,911,702 A * 11/1959 Clyncke ..... 52/699
3,126,928 A * 3/1964 McMillan ..... 52/702
3,429,450 A * 2/1969 Lambert ..... 211/60
3,791,749 A * 2/1974 Grille et al. ..... 403/188
3,995,823 A * 12/1976 Hensel ..... 248/300
4,261,155 A * 4/1981 Gilb ..... 52/702
5,337,534 A * 8/1994 Nasca ..... 52/745.21
5,398,902 A * 3/1995 Crowe ..... 248/300
5,482,240 A * 1/1996 Caraher ..... 248/297.51
5,555,694 A * 9/1996 Commins ..... 52/702
5,670,076 A * 9/1997 Leek ..... 52/702
5,678,797 A * 10/1997 Gogan ..... 248/300
5,688,428 A * 11/1997 Maguire ..... 52/699
5,730,522 A * 3/1998 Wyke et al. ..... 362/432
5,810,303 A * 9/1998 Bourassa et al. ..... 248/205.1
5,813,188 A * 9/1998 Behlen ..... 52/699

OTHER PUBLICATIONS

Hohmann & Barnard, Inc. "Masonry Accessories" © Hohmann & Barnard, Inc. 1975.
Hohmann & Barnard, Inc. "PTA Series Partition Top Anchors".

* cited by examiner

*Primary Examiner*—Kimberly Wood
(74) *Attorney, Agent, or Firm*—Jenner & Block, LLC

(57) ABSTRACT

A reinforcement bar support system transfers forces perpendicular to a wall to a surrounding frame while permitting movement of the wall with respect to the frame in the direction of the plane of the wall and in the vertical direction. A bar is built into the wall. The apparatus includes a brace that is attached to the frame and a face that projects from the brace. Flanges extend outwardly from the face to receive the bar and limit movement of the bar with respect to the frame in the direction perpendicular to the wall.

6 Claims, 4 Drawing Sheets

REINFORCEMENT BAR SUPPORT SYSTEM

BACKGROUND OF THE INVENTION

1. Field of the Invention

The invention relates generally to a reinforcement bar support system, and more particularly, to a system that transfers forces perpendicular to a wall from a vertical reinforcing bar or post-tensioning rod to a surrounding frame while permitting vertical and horizontal movement of the wall with respect to the frame in the direction of the plane of the wall.

2. Description of the Related Art

Various types of anchors are known for stabilizing walls to other walls, floors, or beams. These anchors often allow for vertical movement of the wall with respect to another wall, floor or beam. Several fixed anchors for use with an overhead frame typically are embedded in masonry mortar head joints or bed joints, and therefore limit horizontal movement of the wall in all directions with respect to the frame. Such anchors can cause problems with forces in the plane of the wall resulting from seismic activity, volume changes due to temperature drying shrinkage, carbonation or other phenomenon. In particular, it has been found that when such anchors are used, these forces can result in separation of the wall from the surrounding frame.

In addition, there are anchor assemblies that are embedded into mortar joints or grout-filled cells in masonry that allow in-plane wall movement while resisting forces perpendicular to the plane of the wall. These assemblies are used where there is no vertical reinforcement in the wall that needs to be anchored at its ends.

Thus, it would be desirable to have an apparatus that can be used to transmit forces in a direction perpendicular to a wall from the wall to the frame while permitting vertical and horizontal movement of the wall with respect to the frame when used in conjunction with a reinforced or prestressed masonry wall.

SUMMARY OF THE INVENTION

The present invention is an apparatus for attaching reinforced or prestressed masonry to its supporting frame or other structural element by receiving and encapsulating a bar built into a wall. The apparatus transfers forces in a direction perpendicular to the plane of the wall from the wall to the frame or other structural element while allowing in-plane movement of the wall with respect to the frame. The apparatus generally includes a first means for attaching the apparatus to the frame and a second means connected to the first means for receiving the bar and limiting movement of the bar with respect to the frame in one axis while permitting movement of the bar in two other axes. In particular, the second means can limit movement of the bar in a direction perpendicular to the plane of the wall while permitting movement in the plane of the wall.

More specifically, the apparatus of the present invention preferably includes a brace defining at least one adjustment slot, a face projecting from the brace and a first flange extending outwardly from the face, the first flange limiting movement of the bar. The brace is attached to the frame. The brace preferably has two parallel adjustment slots. Preferably, the apparatus also includes a second flange extending outwardly from the face opposite the first flange such that the first and second flanges define a bar receiving area. The first and second flanges each can have one end connected to the face and opposite ends that are independent of one another. The first and second flanges can be formed from the face. Alternatively, a separate piece forming the flanges can be attached to the face. The first flange preferably extends parallel to the second flange. Both the first and second flange can extend substantially perpendicular to the face. In an alternative embodiment, the first flange can diverge from the second flange, e.g., to define a truncated V-shaped bar receiving area. Both the brace and the face can be planar with the face perpendicular to the brace.

In an alternative embodiment, the apparatus includes a first planar brace defining a first adjustment slot, a second planar brace defining a second adjustment slot, a face projecting from the first and second braces and a first flange extending outwardly from the face. The first flange limits movement of the bar. The first and second brace can be coplanar. In this embodiment, the apparatus also can include a second flange extending outwardly from the face opposite the first flange such that the first and second flanges define a bar receiving area. The first and second flanges each have one end connected to the face and opposite ends that are independent of one another. The first and second flanges can be formed from the face. The first flange can extend substantially parallel to the second flange. The first and second flange can extend substantially perpendicular to the face. Alternatively, the first flange can diverge from the second flange. The first and second flanges can define a truncated V-shaped bar receiving area. The face preferably is perpendicular to the first and second braces.

In another alternative embodiment, the apparatus is used in conjunction with a plurality of bars. In this embodiment, the apparatus includes a brace defining at least one adjustment slot, a face projecting from the brace and a plurality of flanges extending outwardly from the face. The flanges limit movement of the bars. The brace can alternatively define a plurality of adjustment slots which can be parallel. Each successive pair of flanges can limit movement of a respective one of the bars. The first and second flange of at least one of the successive pairs of flanges has one end connected to the face and opposite ends that are independent of one another. The first and second flanges can be formed from the face. The first flange can extend substantially parallel to the second flange. The first and second flanges can extend substantially perpendicular to the face. Alternatively, the first flange diverges from the second flange. In this case, the first and second flanges can define a truncated V-shaped bar receiving area. The brace and the face can be planar with the face perpendicular to the brace. In other embodiments, three or four flanges may be included. In alternative embodiments, the flanges extend in a plane perpendicular, rather than parallel, to the longitudinal axis of the bar.

DETAILED DESCRIPTION OF THE PREFERRED EMBODIMENT

Figure 1:
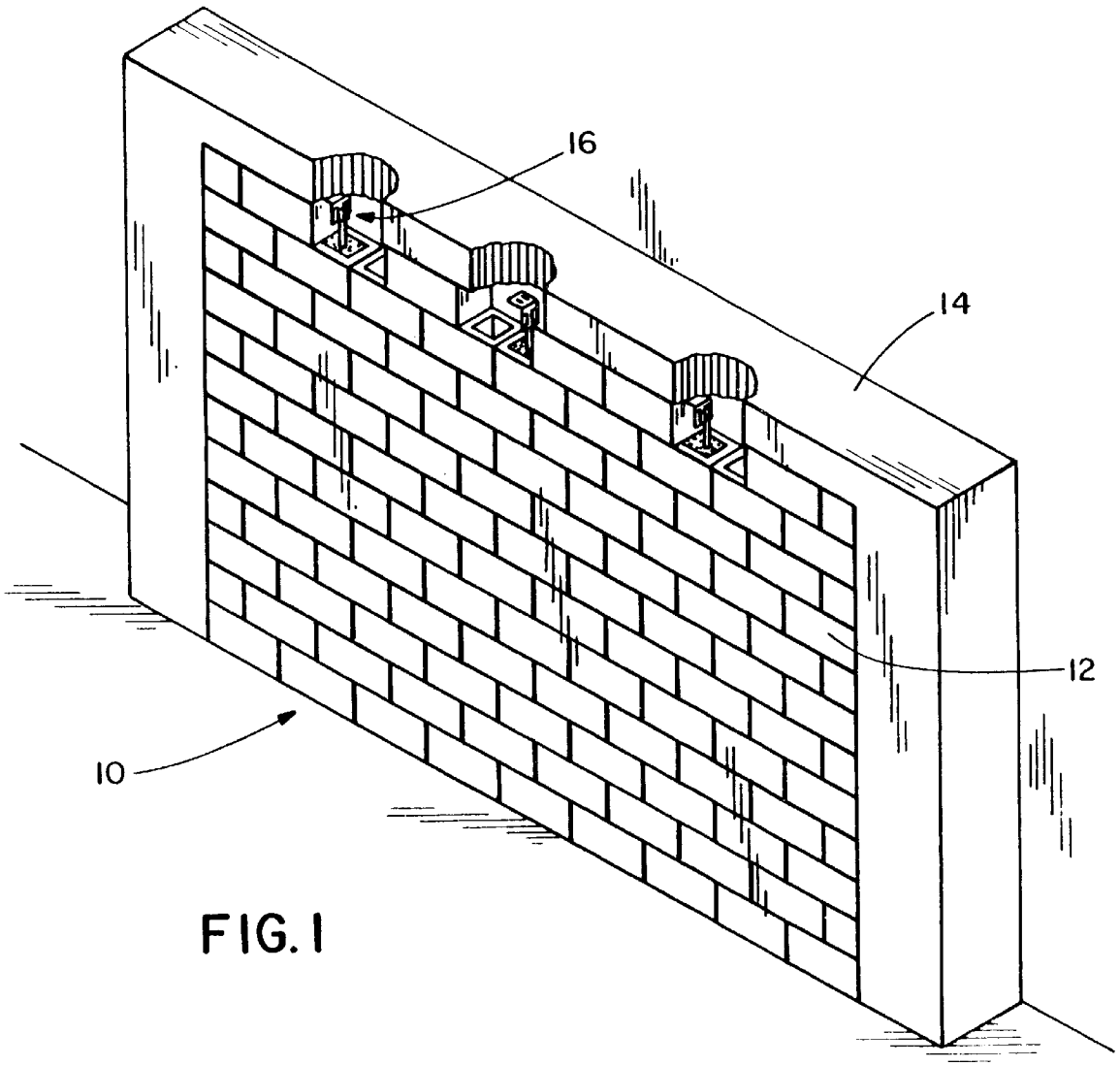
FIG. 1 is a perspective view of a frame and masonry wall with the frame partially broken away to illustrate a reinforcement bar system.
Figure 2:
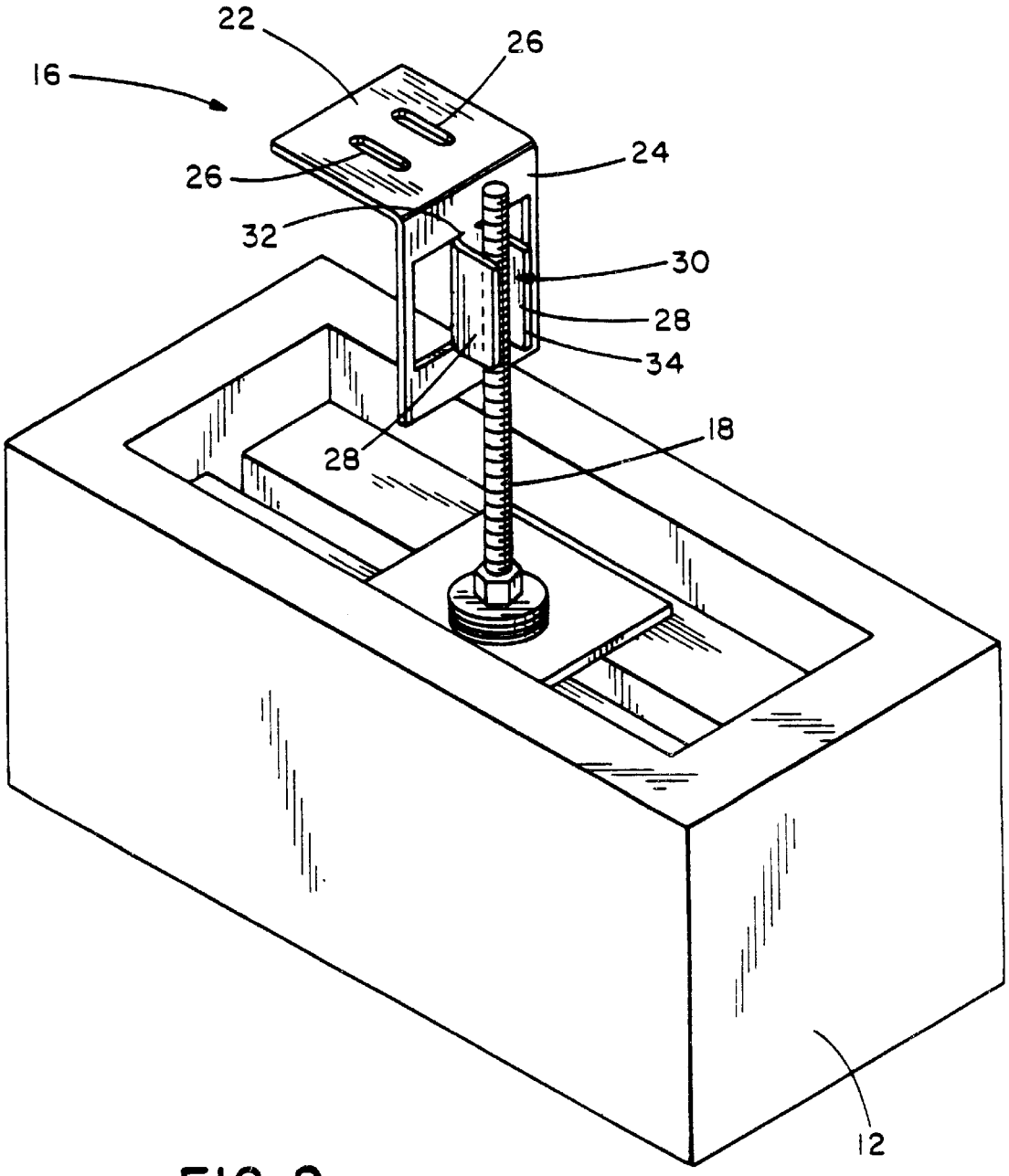
FIG. 2 is a perspective view of an apparatus of the present invention used in conjunction with a cell of a masonry wall having a vertical post-tensioning bar.
Figure 3:
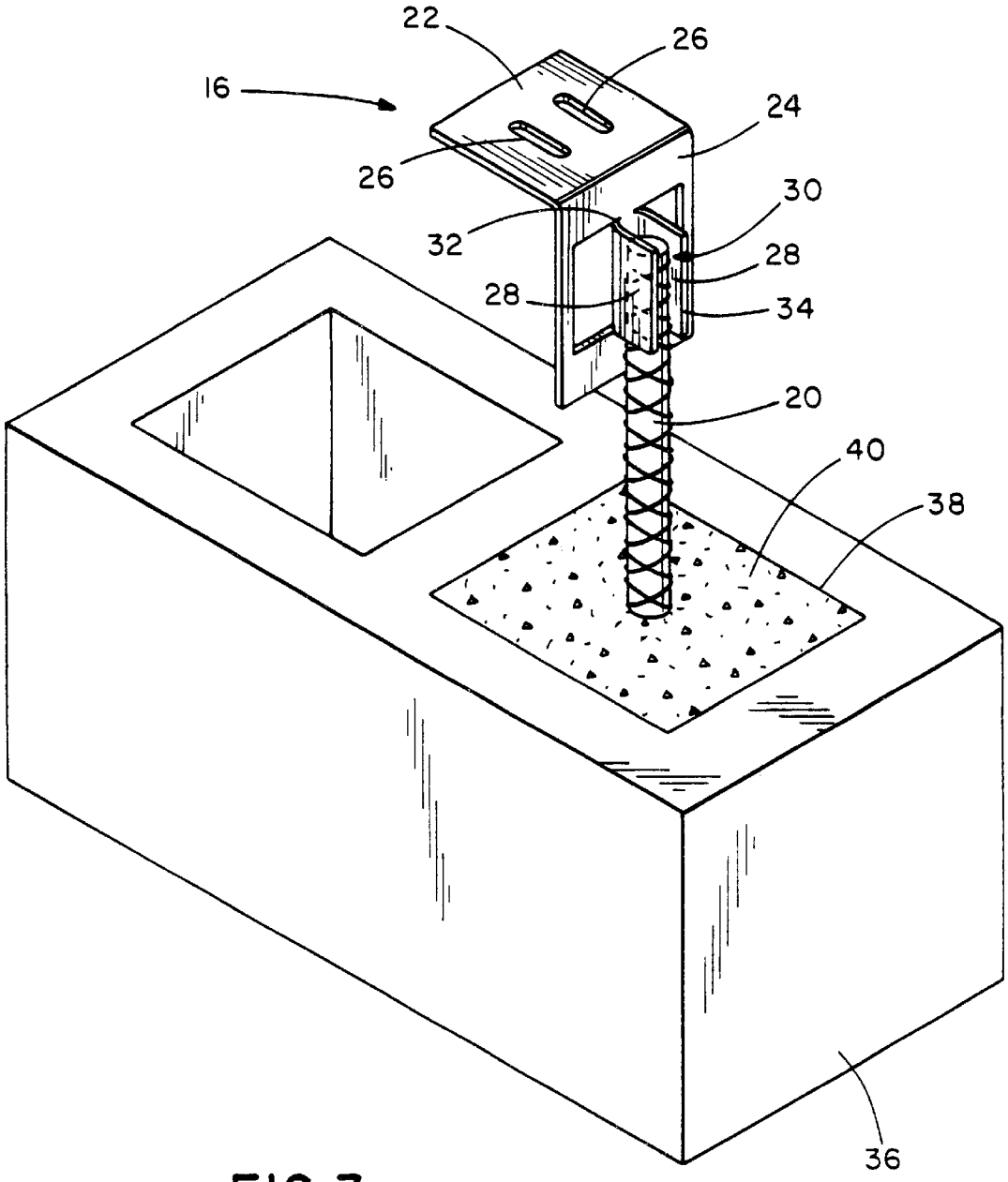
FIG. 3 is a perspective view of an apparatus of the present invention used in conjunction with a cell a masonry wall having a vertical reinforcement bar.

Referring first to FIG. 1, there is shown a masonry wall 10 made from a plurality of masonry units 12 and bounded by a frame 14. It is desirable to transfer forces in a direction perpendicular to the plane of wall 10 to frame 14 through a vertical reinforcement bar or post-tension rod. In FIG. 1, frame 14 is partially broken away to show an apparatus 16 in accordance with the present invention. As shown in FIGS. 2 and 3, apparatus 16 can be used in conjunction with a vertical post-tensioning bar 18 or vertical reinforcement bar (or rebar) 20 to transfer forces perpendicular to the plane of wall 10 to frame 14. Apparatus 16 advantageously encaptures the vertical reinforcement bar 20 and allows for vertical movement of wall 10 with respect to frame 14. Apparatus 16 also allows for in-plane movement of wall 10 with respect to frame 14.

Turning now to FIG. 2, there is shown apparatus 16 for use in conjunction with vertical post-tensioning bar 18. Apparatus 16 generally includes a brace 22 and a face 24. Brace 22 can include at least one, and preferably two, adjustment slots 26. Adjustment slots 26 receive suitable attachment means, such as expansion anchors, powder driven anchors or bolts or some other fastener, (not shown) for attaching brace 22 to frame 14. An alternative method is to field weld brace 22 to a steel frame. Slots 26 preferably are parallel to each other to provide additional adjustment in the plane of the wall. Face 24 includes at least one, and preferably two, flanges 28 extending outwardly from face 24 to define a bar receiving area 30. Flanges 28 limit movement of bar 18 in a direction perpendicular to wall 10. Flanges 28 preferably are formed from face 24 and each flange 28 has a first end 32 connected to face 24 and a second end 34 independent of the other flange 28. Alternatively, flanges 28 can be part of a separate u-shaped channel that is attached to a solid face 24 by welding for extra strength. Flanges 28 preferably extend substantially parallel to one another as shown in FIG. 2. However, other configurations of flanges 28 can be used, if desired. For example, flanges 28 can diverge from one another, e.g., to form a truncated V-shaped or trapezoid-shaped bar receiving area 30 to accommodate different size bars 18 with the same apparatus 16. Alternatively, a single flange can be used that is shaped so as to define an appropriate bar receiving area.

FIG. 3 shows apparatus 16 in use in conjunction with a vertical rebar 20. Vertical rebar 20 can be used with a hollow masonry unit 36 which has a cell 38 filled with concrete or grout 40. Apparatus 16 can be identical to that depicted in FIG. 2. Apparatus 16 preferably is made from steel. Apparatus 16 should be of such size that face 24 fits within the width of the masonry unit. Also, apparatus 16 should not be larger than the height of the masonry unit.

Figure 4:
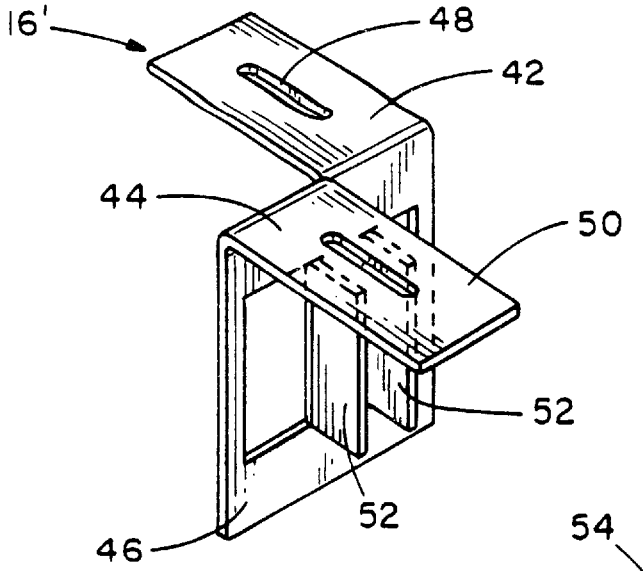
FIG. 4 is a alternative embodiment of the apparatus of the present invention.

An alternative apparatus 16' is shown in FIG. 4. Apparatus 16' generally includes a first planar brace 42, a second planar brace 44 and a face 46. Brace 42 defines a first adjustment slot 48 and brace 44 defines a second adjustment slot 50. Brace 42 and brace 44 are coplanar. Face 46 is similar to face 24 and includes flanges 52 similar to flanges 28.

Figure 5:
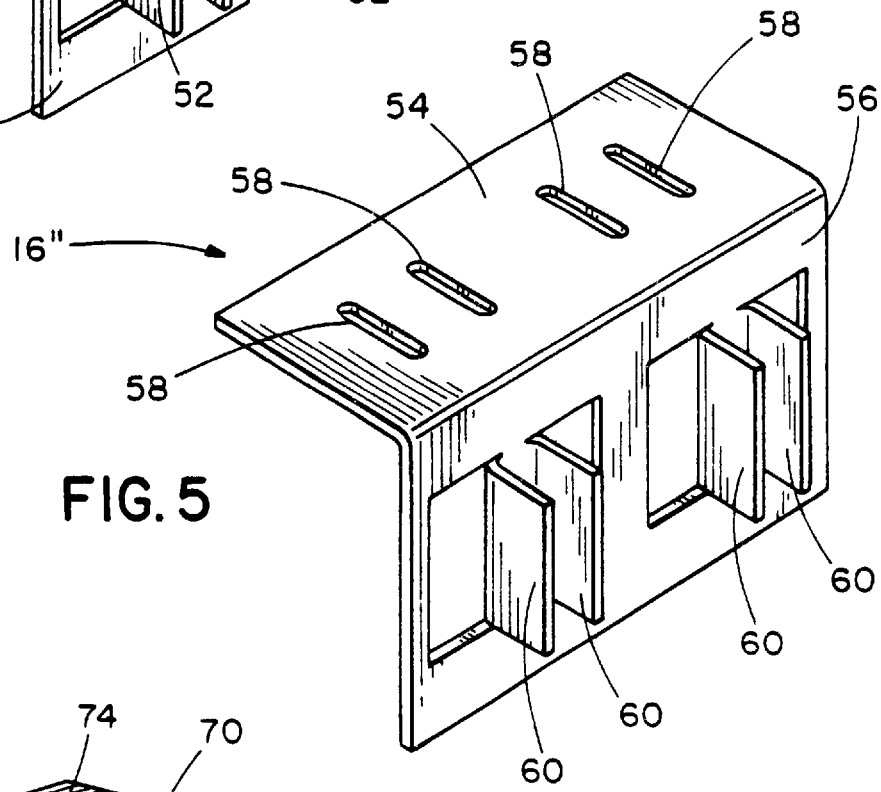
FIG. 5 is a second alternative embodiment of the apparatus of the present invention.

Another alternative apparatus 16" is shown in FIG. 5. Apparatus 16" generally includes a brace 54 and a face 56. Brace 54 can define at least one adjustment slot 58. A plurality of flanges 60 extend outwardly from face 56. Each successive pair of flanges 60 limits movement of one bar, such as post-tensioning bar 18 or rebar 20. Other flange configurations also are possible. For example, instead of having two flanges for each bar, there could be a total of N+1 flanges for every N bars. Thus, three flanges could be used to receive two bars, with the first bar housed between the first and second flanges and the second bar housed between the second and third flanges.

Figure 6:
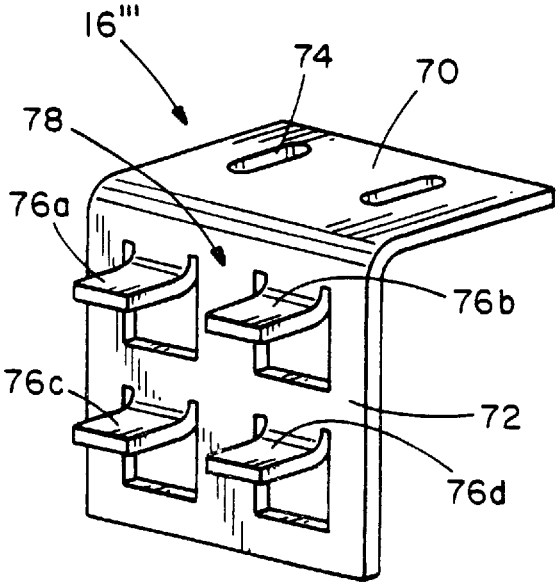
FIG. 6 is a third alternative embodiment of the apparatus of the present invention.

Yet another alternative apparatus 16''' is shown in FIG. 6. Apparatus 16''' generally includes a brace 70 and a face 72. Brace 70 can include at least one adjustment slot 74. A plurality of flanges 76*a–d* extend outwardly from face 72 in a direction generally perpendicular to the previously described embodiments. Thus, flanges 76*a–d* extend in a plane perpendicular, rather than parallel, to the longitudinal axis of the bar. Flanges 76*a–d* define a bar receiving area 78. Flanges 76*a* and 76*b* are generally coplanar. Flanges 76*c* and 76*d* also are generally coplanar. As shown in FIG. 6, flanges 76*a* and 76*c* are on a first side of bar receiving area 78, while flanges 76*b* and 76*d* are on an opposite side of bar receiving area 78. Alternatively, three flanges can be used, with two flanges on one side and the third flange on the opposite side of bar receiving area 78. Thus, for example, flange 76*c* in FIG. 6 could be eliminated. In that case, flange 76*a* preferably would be located in a lower position than that shown in FIG. 6. In particular, flange 76*a* would be positioned higher than flange 76*d* but lower than flange 76*b*.

Now that several possible configurations of apparatus 16 have been demonstrated, a brief discussion of the method for building a framed wall using apparatus 16 will be given. Initially, the ceiling or frame 14 is installed. Masonry units 12 then are installed to begin construction of wall 10 and rebars 20 (or post-tensioning bars 18) are inserted. Rebars 20 (or post-tensioning bars 18) are installed during the construction of the wall and extend almost to the bottom of frame 14 so that as frame 14 deflects downwardly there will be no interference. Generally, rebar 20 (or post-tensioning bar 18) extends one-half of the height of a masonry unit above the next to last unit to be installed. Wall 10 is built up short of its full height near apparatus 16. Apparatus 16 is then attached to frame 14 by placing anchors or bolts through adjustment slots 26 or welding apparatus 16 to frame 14. Apparatus 16 is adjusted to place flanges 28 around rebar 20. The masonry unit 12 directly below brace 22 is then inserted. Upon completion of the construction of wall 10, apparatus 16 serves to transfer forces in a direction perpendicular to wall 10 to frame 14, while allowing wall 10 to sag and deflect vertically as well as to move in the plane of wall 10 with respect to frame 14.

Whereas the present invention has been described with respect to specific embodiments thereof, it will be understood that various changes and modifications will be suggested to one skilled in the art and it is intended that the invention encompass such changes and modifications as fall within the scope of the appended claims.

What is claimed is:

1. An apparatus to be attached to a frame of a wall defining a plane, comprising:

a bar;

first means for attaching the apparatus to the frame; and second means connected to said first means for receiving the bar and limiting movement of the bar with respect to the frame in one axis while permitting movement of the bar in two axes.

2. The apparatus of claim 1 wherein said second means limits movement of the bar with respect to the frame in a direction perpendicular to the plane of the wall while permitting movement in the plane of the wall.

3. An apparatus to be attached to a frame of a wall defining a plane, comprising:

a bar;

a brace defining at least one adjustment slot;

a face projecting from said brace;

a first flange extending outwardly from said face, said first flange limiting movement of the bar;

a second flange extending outwardly from said face opposite said first flange, such that said first flange and said second flange define a bar receiving area;

said first flange extends substantially parallel to said second flange; and said first and second flanges each has one end connected to said face and opposite ends that are independent of one another.

4. An apparatus to be attached to a frame of a wall defining a plane, comprising:

a bar;

a brace defining at least one adjustment slot;

a face projecting from said brace;

a first flange extending outwardly from said face, said first flange limiting movement of the bar;

a second flange extending outwardly from said face opposite said first flange, such that said first flange and said second flange define a bar receiving area;

said first flange extends substantially parallel to said second flange;

each of said first flange and said second flange extends in a plane parallel to a longitudinal axis of the bar; and said first and second flanges each has one end connected to said face and opposite ends that are independent of one another.

5. An apparatus to be attached to a frame of a wall defining a plane, comprising:

a bar;

a brace defining at least one adjustment slot;

a face projecting from said brace;

a first flange extending outwardly from said face, said first flange limiting movement of the bar;

a second flange extending outwardly from said face opposite said first flange, such that said first flange and said second flange define a bar receiving area;

said first flange extends substantially parallel to said second flange;

said first flange and said second flange extend substantially perpendicular to said face; and said first and second flanges each has one end connected to said face and opposite ends that are independent of one another.

6. An apparatus to be attached to a frame of a wall defining a plane, comprising:

a bar;

a brace defining at least one adjustment slot;

a face projecting from said brace;

a first flange extending outwardly from said face, said first flange limiting movement of the bar;

a second flange extending outwardly from said face opposite said first flange, such that said first flange and said second flange define a bar receiving area;

said first flange and said second flange define a truncated V-shaped bar receiving area;

said first and second flanges each has one end connected to said face and opposite ends that are independent of one another; and said first flange diverges from said second flange.

* * * * *